US012781307B2

(12) United States Patent
Matsumoto et al.

(10) Patent No.: US 12,781,307 B2
(45) Date of Patent: Nov. 3, 2026

(54) PLATINUM-GROUP METAL RECOVERY AGENT AND PLATINUM-GROUP METAL RECOVERY METHOD

(71) Applicant: MITSUBISHI GAS CHEMICAL COMPANY, INC., Tokyo (JP)

(72) Inventors: Kazuya Matsumoto, Akita (JP); Mitsutoshi Jikei, Akita (JP)

(73) Assignee: MITSUBISHI GAS CHEMICAL COMPANY, INC., Tokyo (JP)

( * ) Notice: Subject to any disclaimer, the term of this patent is extended or adjusted under 35 U.S.C. 154(b) by 603 days.

(21) Appl. No.: 18/279,546

(22) PCT Filed: Feb. 8, 2022

(86) PCT No.: PCT/JP2022/004961
§ 371 (c)(1),
(2) Date: Aug. 30, 2023

(87) PCT Pub. No.: WO2022/185862
PCT Pub. Date: Sep. 9, 2022

(65) Prior Publication Data

US 2024/0167120 A1 May 23, 2024

(30) Foreign Application Priority Data

Mar. 3, 2021 (JP) ..... 2021-033855

(51) Int. Cl.
*C22B 11/00* (2006.01)
*C22B 7/00* (2006.01)

(52) U.S. Cl.
CPC ..... *C22B 11/048* (2013.01); *C22B 7/007* (2013.01)

(58) Field of Classification Search
CPC ..... C22B 11/048; C22B 7/007; C22B 3/44; C22B 3/10; Y02P 10/20
See application file for complete search history.

(56) References Cited

FOREIGN PATENT DOCUMENTS

DE 2219531 11/1973
JP 11319538 A * 11/1999 ..... Y02P 10/20
(Continued)

OTHER PUBLICATIONS

Smokefoot: "Diamine—Wikipedia", , Oct. 9, 2020 (Oct. 9, 2020), pp. 1-4, XP093196694,Retrieved from the Internet: URL:https://en.wikipedia.org/w/index.php?title=Diamine&oldid=982658003.
(Continued)

*Primary Examiner* — Anthony J Zimmer
*Assistant Examiner* — Syed T Iqbal
(74) *Attorney, Agent, or Firm* — Greenblum & Bernstein, P.L.C.

(57) ABSTRACT

Provided are a platinum-group metal recovery agent represented by the following general Formula (1) and a platinum-group metal recovery method, which is a method of recovering platinum or rhodium from a hydrochloric acid solution containing platinum or rhodium using the platinum-group metal recovery agent, in which the platinum-group metal recovery agent and the hydrochloric acid solution are mixed to precipitate platinum or rhodium.

(1)

20 Claims, 5 Drawing Sheets

(56) References Cited

FOREIGN PATENT DOCUMENTS

| | | | | |
|---|---|---|---|---|
| JP | H11319538 | A | * | 11/1999 |
| JP | 2005-194546 | A | | 7/2005 |
| JP | 2008-126211 | | | 6/2008 |
| JP | 2017-179409 | A | | 10/2017 |
| JP | 2019-206747 | A | | 12/2017 |
| WO | 2017/170444 | A1 | | 10/2017 |

OTHER PUBLICATIONS

Matsumoto Kazuya et al: "Selective and Mutual Separation of Palladium (II), Platinum (IV), and Rhodium (III) Using Aliphatic Primary Amines", Metals,vol. 10, No. 3, Feb. 29, 2020 (Feb. 29, 2020), pp. 324-333, XP093196701,CH ISSN: 2075-4701, DOI: 10.3390/met10030324.

Chemical Products Handbook Organochemicals, (Manual—Organic Chemical Raw Materials), Edited by the Chemical Industry Institute of Science and Technology Intelligence, pp. 331-332, Chemical Industry Press, Jun. 1985, together with English translation of Official Action dated Apr. 8, 2025 in Chinese family member application No. 202280017723.5 as concise explanation of relevance.

International Search Report issued Apr. 26, 2022 in International Bureau of WIPO Patent Application No. PCT/JP2022/004961, with an English translation thereof.

Written Opinion issued Apr. 26, 2022 in International Bureau of WIPO Patent Application No. PCT/JP2022/004961, with an English translation thereof.

* cited by examiner

PLATINUM-GROUP METAL RECOVERY AGENT AND PLATINUM-GROUP METAL RECOVERY METHOD

TECHNICAL FIELD

The present invention relates to a platinum-group metal recovery agent and a platinum-group metal recovery method.

BACKGROUND ART

Platinum-group metals are of great industrial importance. Among them, platinum, palladium and rhodium are mainly used as automobile exhaust gas purifying catalysts. Therefore, it is important to selectively separate and recover platinum-group metals from spent catalysts.

In general, methods such as an electrolytic deposition method, a cementation method, an ion exchange method, a precipitation method, and a solvent extraction method are used to recover noble metals. Among these methods, the precipitation method and solvent extraction method, which are excellent in economical efficiency and operability, are widely used.

As a method for selectively recovering a platinum-group metal by the precipitation method, a method using an amine has been studied.

For example, Patent Document 1 discloses a rhodium recovery agent that has an amide bond and a phenylenediamine structure and is a solid insoluble in hydrochloric acid at a specific concentration for the purpose of efficiently recovering rhodium at low cost.

Patent Document 2 discloses that a platinum-group metal can be precipitated and recovered by adding a compound having a diaminodiphenyl structure to a hydrochloric acid solution containing the platinum-group metal, particularly for the purpose of efficiently separating rhodium.

CITATION LIST

Patent Document

Patent Document 1: JP 2017-179409 A
Patent Document 2: JP 2019-206747 A

SUMMARY OF INVENTION

Technical Problem

In the recovery of platinum-group metals by the known precipitation method or solvent extraction method, palladium is preferentially recovered, and it is difficult to selectively recover platinum and rhodium first. Although Patent Documents 1 and 2 disclose methods of recovering rhodium, platinum cannot be preferentially and selectively recovered. Therefore, there is a demand for a method capable of preferentially and selectively recovering platinum even in the presence of palladium and rhodium, and further capable of selectively recovering rhodium in the presence of palladium.

Accordingly, an object of the present invention is to provide a platinum-group metal recovery agent and a platinum-group metal recovery method, which are capable of selectively recovering each of platinum and rhodium at a high recovery rate.

Solution to Problem

The present inventors have found that xylylenediamine is excellent as a platinum-group metal recovery agent. Further, the present inventors have found a method capable of selectively recovering each of platinum and rhodium at a high recovery rate by using the platinum-group metal recovery agent. Furthermore, the present inventors have found a method of preferentially and selectively recovering platinum even in the presence of palladium and rhodium, and then selectively recovering rhodium, which has been difficult in the past, and have completed the present invention.

That is, the present invention relates to a platinum-group metal recovery agent represented by the following general Formula (1) and a platinum-group metal recovery method, which is a method of recovering platinum or rhodium from a hydrochloric acid solution containing platinum or rhodium using the platinum-group metal recovery agent, the method including mixing the platinum-group metal recovery agent and the hydrochloric acid solution to precipitate platinum or rhodium:

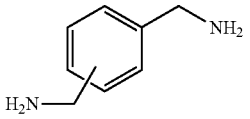

(1)

Advantageous Effects of Invention

The present invention can provide a platinum-group metal recovery agent and a platinum-group metal recovery method, which are capable of selectively recovering each of platinum and rhodium at a high recovery rate.

DESCRIPTION OF EMBODIMENTS

Platinum-Group Metal Recovery Agent

Figure 1:
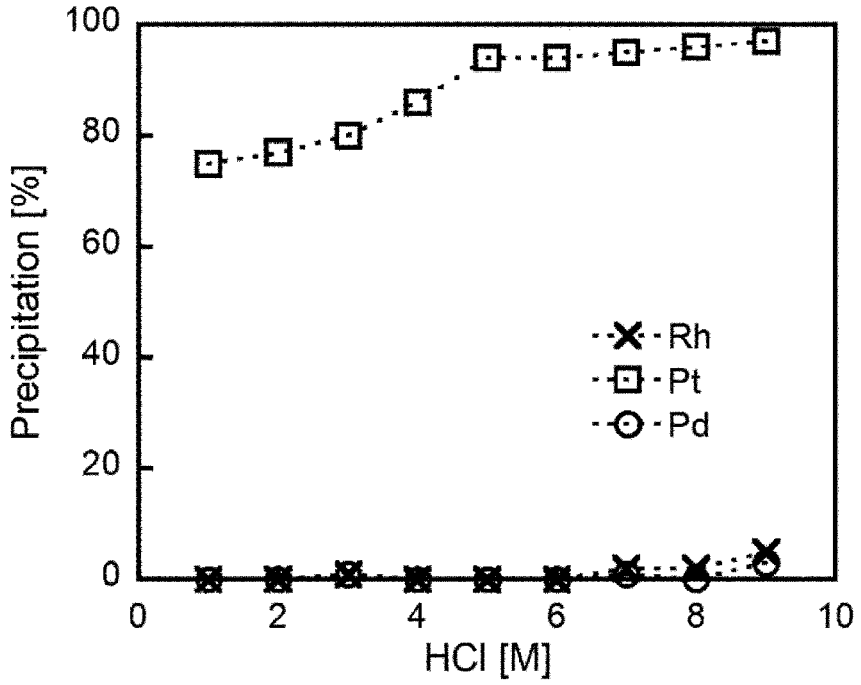
FIG. 1 is a graph indicating the influence of hydrochloric acid concentration on the recovery of platinum in Example 1.

The platinum-group metal recovery agent of the present invention is represented by the following general Formula (1):

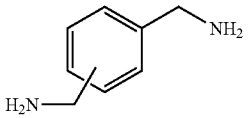

(1)

That is, the platinum-group metal recovery agent of the present invention is a xylylenediamine Among xylylenediamines, the platinum-group metal recovery agent is preferably at least one selected from the group consisting of m-xylylenediamine and p-xylylenediamine, and more preferably m-xylylenediamine.

When a xylylenediamine, particularly m-xylylenediamine, is used as the platinum-group metal recovery agent, each of platinum and rhodium can be selectively recovered at a high recovery rate. Furthermore, platinum can be preferentially and selectively recovered even in the presence of palladium and rhodium, and rhodium can be preferentially and selectively recovered even in the presence of palladium, which has been difficult so far.

The reason why each of platinum and rhodium can be selectively recovered by using the platinum-group metal recovery agent of the present invention is not clear, but is considered to be because, when the platinum-group metal recovery agent is mixed with a hydrochloric acid solution of platinum-group metals, crystals having a specific structure are formed with each of the platinum-group metals to allow for selective precipitation.

For the xylylenediamine, one type may be used alone, or two or more types may be used in combination. When xylylenediamines are used in combination, a mixture containing m-xylylenediamine and p-xylylenediamine is preferable.

While the platinum-group metal recovery agent of the present invention is a xylylenediamine, a hydrohalic acid salt form of xylylenediamine is also included. The hydrohalic acid salt of xylylenediamine is preferably a hydrochloride of xylylenediamine. When the platinum-group metal recovery agent of the present invention is a hydrochloride of xylylenediamine, heat generation and a change in hydrochloric acid concentration due to a neutralization reaction can be prevented when the platinum-group metal recovery agent is mixed with a hydrochloric acid solution containing a platinum-group metal.

A hydrochloric acid concentration of the hydrochloric acid solution used in the platinum-group metal recovery method in the present specification is a hydrochloric acid concentration after mixing the platinum-group metal recovery agent of the present invention. However, when a hydrochloride of xylylenediamine is used as the platinum-group metal recovery agent of the present invention, the hydrochloric acid concentration does not change, and thus the hydrochloric acid concentration may be a hydrochloric acid concentration before mixing the platinum-group metal recovery agent.

Platinum-Group Metal Recovery Method (Recovery of Platinum)

The platinum-group metal recovery method of the present invention is intended to selectively recover each of platinum and rhodium, and can preferentially recover platinum.

A first embodiment of the platinum-group metal recovery method of the present invention is a method of recovering platinum from a hydrochloric acid solution containing platinum using the platinum-group metal recovery agent, the method including mixing the platinum-group metal recovery agent and the hydrochloric acid solution to precipitate platinum.

According to the platinum-group metal recovery method of the present invention, not only platinum can be recovered from a hydrochloric acid solution containing only platinum as a platinum-group metal, but also platinum can be selectively recovered even when the hydrochloric acid solution contains at least one selected from the group consisting of palladium and rhodium.

A specific method will be described below.

First, the platinum-group metal recovery agent is added to a hydrochloric acid solution containing at least platinum.

By using the platinum-group metal recovery agent of the present invention, platinum can be selectively recovered from a hydrochloric acid solution having various hydrochloric acid concentrations. The hydrochloric acid concentration of the hydrochloric acid solution containing platinum is preferably from 1 to 12 mol/L, more preferably from 4 to 10 mol/L, and still more preferably from 5 to 9 mol/L.

In addition, a concentration of platinum contained in the hydrochloric acid solution is not limited, but is preferably from 100 to 10000 mg/L, more preferably from 300 to 5000 mg/L, and still more preferably from 500 to 2000 mg/L from the viewpoint of efficient recovery.

When the platinum-group metal recovery agent is added, a molar ratio of the platinum-group metal recovery agent to platinum contained in the hydrochloric acid solution, [platinum-group metal recovery agent/platinum (mol/mol)], is preferably 1 or more and less than 100, more preferably 2 or more and less than 40, and still more preferably 5 or more and less than 40.

When the molar ratio is within the above range, the recovery rate of platinum increases, rhodium and palladium are not likely to be contained in the precipitate, and platinum can be recovered with high purity.

The method for mixing the platinum-group metal recovery agent and the hydrochloric acid solution is not limited, and platinum is precipitated by adding the platinum-group metal recovery agent into the hydrochloric acid solution and stirring or shaking the mixture for a predetermined time.

When the platinum-group metal recovery agent of the present invention is used, precipitation readily occurs after mixing with the hydrochloric acid solution, and thus platinum can be recovered in a short period of time. A time for stirring or shaking is preferably 1 minute or longer, and more preferably 5 minutes or longer. An upper limit is not limited, but is preferably 10 hours or shorter, and more preferably 5 hours or shorter, from the viewpoint of efficiency. The time for stirring or shaking may be appropriately adjusted depending on a concentration of each component and a temperature.

The temperature during stirring or shaking may be from 0 to 100° C., and is preferably from 10 to 50° C.

The precipitate containing platinum obtained in the above manner can be recovered by solid-liquid separation such as filtration or centrifugal separation.

Since the precipitate contains platinum as an ion and also contains a platinum-group metal recovery agent which is a chloride ion or xylylenediamine, platinum can be obtained as a metal or oxide by baking it in air. A baking temperature is preferably from 400 to 1000° C., and more preferably from 500 to 700° C. A baking time is preferably from 5 to 100 minutes, and more preferably from 10 to 80 minutes. By adjusting these baking conditions, platinum can be obtained in the form of a metal, preferably a simple metal.

Platinum-Group Metal Recovery Method (Recovery of Rhodium)

The platinum-group metal recovery method of the present invention can also selectively recover rhodium.

A second embodiment of the platinum-group metal recovery method of the present invention is a method of recovering rhodium from a hydrochloric acid solution containing rhodium using the platinum-group metal recovery agent, the method including mixing the platinum-group metal recovery agent and the hydrochloric acid solution to precipitate rhodium.

According to the platinum-group metal recovery method of the present invention, not only rhodium can be recovered from a hydrochloric acid solution containing only rhodium as a platinum-group metal, but also rhodium can be selectively recovered even when the hydrochloric acid solution contains palladium.

A specific method will be described below.

First, the platinum-group metal recovery agent is added to a hydrochloric acid solution containing at least rhodium.

By using the platinum-group metal recovery agent of the present invention, rhodium can be selectively recovered also from hydrochloric acid solutions having a wide range of hydrochloric acid concentrations, and the hydrochloric acid concentration of the hydrochloric acid solution containing rhodium is preferably from 3 to 12 mol/L, more preferably from 4 to 10 mol/L, and still more preferably from 5 to 9 mol/L.

In addition, a concentration of rhodium contained in the hydrochloric acid solution is not limited, but is preferably from 100 to 10000 mg/L, more preferably from 300 to 5000 mg/L, and still more preferably from 500 to 2000 mg/L from the viewpoint of efficient recovery.

When the platinum-group metal recovery agent is added, a molar ratio of the platinum-group metal recovery agent to rhodium contained in the hydrochloric acid solution, [platinum-group metal recovery agent/rhodium (mol/mol)], is preferably 10 or more, more preferably 15 or more, still more preferably 40 or more, and yet still more preferably 50 or more. An upper limit is not limited, but is preferably 200 or less from the viewpoint of efficiency.

When the molar ratio is within the above range, the recovery rate of rhodium increases, palladium is not likely to be contained in the precipitate, and rhodium can be recovered with high purity.

In the present method, a crystal nucleating agent may be further mixed with the hydrochloric acid solution containing rhodium in addition to the platinum-group metal recovery agent. By mixing the crystal nucleating agent, rhodium can be more selectively recovered even when a smaller amount of the platinum-group metal recovery agent is used.

When the crystal nucleating agent is used, the molar ratio of the platinum-group metal recovery agent to rhodium contained in the hydrochloric acid solution, [platinum-group metal recovery agent/rhodium (mol/mol)], is preferably 5 or more, more preferably 10 or more, still more preferably 15 or more, and yet still more preferably 20 or more. An upper limit is not limited, but is preferably 100 or less from the viewpoint of efficiency.

The crystal nucleating agent is preferably a fine particle that is insoluble or hardly soluble in a hydrochloric acid solution. Examples of the crystal nucleating agent include inorganic oxide particles and organic compound crystals. It is more preferable to use the precipitate obtained by the present method as the crystal nucleating agent, and it is still more preferable to use a precipitate containing crystals having a molar ratio of rhodium atoms to the platinum-group metal recovery agent in the crystals, [rhodium atom:platinum-group metal recovery agent], of 1:2.

A size of the crystal nucleating agent is preferably 5 mm or less. A lower limit of the size of the crystal nucleating agent is not limited, but is preferably 0.001 mm or more.

An amount of the crystal nucleating agent used is not particularly limited, but is preferably from 0.1 to 50 g, more preferably from 0.5 to 20 g, and still more preferably from 3 to 15 g per mol of rhodium in the hydrochloric acid solution.

The method for mixing the platinum-group metal recovery agent and the hydrochloric acid solution is not limited, but, preferably, rhodium is precipitated by adding the platinum-group metal recovery agent into the hydrochloric acid solution and stirring or shaking the mixture for a predetermined time.

A time for stirring or shaking is preferably 5 minutes or longer, and more preferably 10 minutes or longer. An upper limit is not limited, but is preferably 10 hours or shorter, and more preferably 5 hours or shorter, from the viewpoint of efficiency. The time for stirring or shaking may be appropriately adjusted depending on a concentration of each component and a temperature.

The temperature during stirring or shaking may be from 0 to 100° C., and is preferably from 10 to 50° C.

The precipitate containing rhodium obtained in the above manner can be recovered by solid-liquid separation such as filtration or centrifugal separation.

Since the precipitate contains rhodium as an ion and also contains a platinum-group metal recovery agent which is a chloride ion or xylylenediamine, rhodium can be obtained as a metal or oxide by baking it in air. A baking temperature is preferably from 400 to 1500° C., and more preferably from 450 to 1200° C. A baking time is preferably from 5 to 100 minutes, and more preferably from 10 to 80 minutes. By adjusting these baking conditions, rhodium can be obtained in the form of a metal, preferably a simple metal.

Platinum-Group Metal Recovery Method (Sequential Recovery of Platinum and Rhodium)

According to the platinum-group metal recovery method of the present invention, each of platinum and rhodium can be selectively recovered as described above, and can be separated and recovered from the hydrochloric acid solution containing platinum and rhodium.

That is, a third embodiment of the platinum-group metal recovery method of the present invention is a platinum-group metal recovery method for separating and recovering platinum and rhodium from a hydrochloric acid solution containing platinum and rhodium using the platinum-group metal recovery agent, the method including: a platinum recovery step of mixing the platinum-group metal recovery agent and the hydrochloric acid solution to obtain a precipitate containing platinum and a solution containing rhodium and recovering platinum; and a rhodium recovery step of mixing the platinum-group metal recovery agent and the solution containing rhodium to obtain a precipitate containing rhodium and recovering rhodium.

According to the present method, even when the hydrochloric acid solution contains palladium, it is possible to separate and recover each of platinum and rhodium from the hydrochloric acid solution containing platinum and rhodium. That is, in another embodiment of the platinum-group metal recovery method of the present invention, the hydrochloric acid solution contains palladium, the platinum recovery step is a step of obtaining a precipitate containing platinum and a solution containing rhodium and palladium, and the rhodium recovery step is a step of obtaining a precipitate containing rhodium and a solution containing palladium.

The first step of the present embodiments is the platinum recovery step of mixing the platinum-group metal recovery agent and the hydrochloric acid solution to obtain a precipitate containing platinum and a solution containing rhodium.

This step is preferably performed by the method and under the conditions described in the above [Platinum-group metal recovery method (Recovery of platinum)] section. In particular, from the viewpoint of obtaining a precipitate containing platinum while preventing the precipitation of rhodium, this step is preferably performed under the following conditions.

The hydrochloric acid concentration of the hydrochloric acid solution containing platinum and rhodium is preferably from 1 to 12 mol/L, more preferably from 4 to 10 mol/L, and still more preferably from 5 to 9 mol/L.

In addition, concentrations of platinum and rhodium contained in the hydrochloric acid solution are not limited, but a concentration of platinum contained in the hydrochloric acid solution is preferably from 100 to 10000 mg/L, more preferably from 300 to 5000 mg/L, and still more preferably from 500 to 2000 mg/L from the viewpoint of efficient recovery. In addition, a concentration of rhodium contained in the hydrochloric acid solution is preferably from 100 to 10000 mg/L, more preferably from 300 to 5000 mg/L, and still more preferably from 500 to 2000 mg/L.

When the platinum-group metal recovery agent is added, a molar ratio of the platinum-group metal recovery agent to platinum contained in the hydrochloric acid solution, [platinum-group metal recovery agent/platinum (mol/mol)], is preferably 1 or more and less than 40, more preferably 2 or more and less than 40, and still more preferably 5 or more and less than 40.

When the molar ratio is within the above range, particularly less than 40, the recovery rate of platinum increases, rhodium is not likely to be contained in the precipitate, and platinum can be recovered with high purity.

The method for mixing the platinum-group metal recovery agent and the hydrochloric acid solution is not limited, and platinum is precipitated by adding the platinum-group metal recovery agent into the hydrochloric acid solution and stirring or shaking the mixture for a predetermined time.

When the platinum-group metal recovery agent of the present invention is used, precipitation occurs rapidly after mixing thereof with the hydrochloric acid solution, and thus platinum can be recovered in a short period of time. A time for stirring or shaking is preferably 1 minute or longer, and more preferably 5 minutes or longer. An upper limit is not limited, but is preferably 10 hours or shorter, and more preferably 5 hours or shorter, from the viewpoint of efficiency. The time for stirring or shaking may be appropriately adjusted depending on a concentration of each component and a temperature.

The temperature during stirring or shaking may be from 0 to 100° C., and is preferably from 10 to 50° C.

The precipitate containing platinum obtained in the above manner can be recovered by solid-liquid separation such as filtration or centrifugal separation, and a solution containing rhodium is obtained after the recovery of the precipitate.

Since the precipitate contains platinum as an ion and also contains a platinum-group metal recovery agent which is a chloride ion or xylylenediamine, platinum can be obtained as a metal or oxide by baking it in air. A baking temperature is preferably from 400 to 1000° C., and more preferably from 500 to 700° C. A baking time is preferably from 5 to 100 minutes, and more preferably from 10 to 80 minutes. By adjusting these baking conditions, platinum can be obtained in the form of a metal, preferably a simple metal.

The second step of the present embodiments is the rhodium recovery step of mixing the platinum-group metal recovery agent and the solution containing rhodium obtained in the platinum recovery step to obtain a precipitate containing rhodium, and recovering rhodium.

This step is preferably performed by the method and under the conditions described in the above [Platinum-group metal recovery method (Recovery of rhodium)] section, and is particularly preferably performed under the following conditions from the viewpoint of obtaining a precipitate containing rhodium while preventing the precipitation of palladium.

The hydrochloric acid concentration of the hydrochloric acid solution containing rhodium is preferably from 3 to 12 mol/L, more preferably from 4 to 10 mol/L, and still more preferably from 5 to 9 mol/L.

In addition, a concentration of rhodium contained in the hydrochloric acid solution is not limited, but is preferably from 100 to 10000 mg/L, more preferably from 300 to 5000 mg/L, and still more preferably from 500 to 2000 mg/L from the viewpoint of efficient recovery.

When the platinum-group metal recovery agent is added, a molar ratio of the platinum-group metal recovery agent to rhodium contained in the hydrochloric acid solution, [platinum-group metal recovery agent/rhodium (mol/mol)], is preferably 10 or more, more preferably 15 or more, still more preferably 40 or more, and yet still more preferably 50 or more. An upper limit is not limited, but is preferably 200 or less from the viewpoint of efficiency. When the platinum-group metal recovery agent added in the previous step remains in the hydrochloric acid solution containing rhodium used in this step, this molar ratio is a molar ratio including the remaining platinum-group metal recovery agent.

When the molar ratio is within the above range, the recovery rate of rhodium increases, palladium is not likely to be contained in the precipitate, and rhodium can be recovered with high purity.

In the present method, a crystal nucleating agent may be further mixed with the hydrochloric acid solution containing rhodium in addition to the platinum-group metal recovery agent. By mixing the crystal nucleating agent, rhodium can be more selectively recovered even when a smaller amount of the platinum-group metal recovery agent is used. For the reasons described above, it is preferable to further mix a crystal nucleating agent, in addition to the platinum-group metal recovery agent, into the hydrochloric acid solution containing rhodium, in the present method.

When the crystal nucleating agent is used, the molar ratio of the platinum-group metal recovery agent to rhodium contained in the hydrochloric acid solution, [platinum-group metal recovery agent/rhodium (mol/mol)], is preferably 5 or more, more preferably 10 or more, still more preferably 15 or more, and yet still more preferably 20 or more. An upper limit is not limited, but is preferably 100 or less from the viewpoint of efficiency.

The crystal nucleating agent is preferably a fine particle that is insoluble or hardly soluble in a hydrochloric acid solution, and examples thereof include inorganic oxide particles and organic compound crystals. It is more preferable to use the precipitate obtained by the present method as the crystal nucleating agent, and it is still more preferable to use a precipitate containing crystals having a molar ratio of rhodium atoms to the platinum-group metal recovery agent in the crystals, [rhodium atom:platinum-group metal recovery agent], of 1:2.

A size of the crystal nucleating agent is preferably 5 mm or less. A lower limit of the size of the crystal nucleating agent is not limited, but is preferably 0.001 mm or more.

An amount of the crystal nucleating agent used is not particularly limited, but is preferably from 0.1 to 50 g, more preferably from 0.5 to 20 g, and still more preferably from 3 to 15 g per mol of rhodium in the hydrochloric acid solution.

The method for mixing the platinum-group metal recovery agent and the hydrochloric acid solution is not limited, and rhodium is precipitated by adding the platinum-group metal recovery agent into the hydrochloric acid solution and stirring or shaking the mixture for a predetermined time.

A time for stirring or shaking is preferably 5 minutes or longer, and more preferably 10 minutes or longer. An upper limit is not limited, but is preferably 10 hours or shorter, and more preferably 5 hours or shorter, from the viewpoint of efficiency. The time for stirring or shaking may be appropriately adjusted depending on a concentration of each component and a temperature.

The temperature during stirring or shaking may be from 0 to 100° C., and is preferably from 10 to 50° C.

The precipitate containing rhodium obtained in the above manner can be recovered by solid-liquid separation such as filtration or centrifugal separation.

Since the precipitate contains rhodium as an ion and also contains a platinum-group metal recovery agent which is a chloride ion or xylylenediamine, rhodium can be obtained as a metal or oxide by baking it in air. A baking temperature is preferably from 400 to 1500° C., and more preferably from 450 to 1200° C. A baking time is preferably from 5 to 100 minutes, and more preferably from 10 to 80 minutes. By adjusting these baking conditions, rhodium can be obtained in the form of a metal, preferably a simple metal.

Precipitate

By using the platinum-group metal recovery agent of the present invention as described above, the platinum-group metal in the hydrochloric acid solution can be recovered as a precipitate. The obtained precipitate contains the platinum-group metal recovery agent, hydrochloric acid, chloride ions, water and the like in addition to the platinum-group metal atoms (platinum-group metal ions), and these are contained as crystals in the precipitate.

In the platinum recovery step of the first and third embodiments of the platinum-group metal recovery method according to the present invention, the platinum-group metal recovery agent and the hydrochloric acid solution containing platinum are mixed to precipitate platinum.

The precipitate of the present invention is obtained by these methods and contains crystals having the molar ratio of platinum atoms to the platinum-group metal recovery agent in the crystals, [platinum atom:the platinum-group metal recovery agent], of 1:1.

It is considered that, by forming crystals having the molar ratio of platinum atoms to the platinum-group metal recovery agent of 1:1, other platinum-group metal atoms are eliminated from the crystals and are not incorporated into the precipitate. Therefore, it is considered that platinum can be selectively present in the precipitate obtained by the above method.

In the rhodium recovery step of the second and third embodiments of the platinum-group metal recovery method of the present invention, the platinum-group metal recovery agent and the hydrochloric acid solution containing rhodium are mixed to precipitate rhodium.

The precipitate of the present invention is obtained by these methods and contains crystals having the molar ratio of rhodium atoms to the platinum-group metal recovery agent in the crystals, [rhodium atom:the platinum-group metal recovery agent], of 1:2.

It is considered that, by forming crystals having the molar ratio of rhodium atoms to the platinum-group metal recovery agent of 1:2, palladium and the like are eliminated from the crystals and are not incorporated into the precipitate. Therefore, it is considered that rhodium can be selectively present in the precipitate obtained by the above method.

EXAMPLES

The present invention will be described specifically based on Examples described below, but the present invention is not limited to these Examples.

Recovery of Platinum

Example 1: Influence of Hydrochloric Acid Concentration m-Xylylenediamine was added as a platinum-group metal recovery agent, in an amount which was 15 times (mol/mol) the amount of platinum, to a hydrochloric acid solution containing 500 mg/L of palladium, 1000 mg/L of platinum and 500 mg/L of rhodium and having a hydrochloric acid concentration as indicated in FIG. 1. The m-xylylenediamine used here is a hydrochloride. Thereafter, the mixture was shaken at 25° C. for 1 hour to obtain a precipitate. The obtained precipitate and the solution were subjected to solid-liquid separation by centrifugal separation. The solution obtained after the solid-liquid separation was analyzed by ICP, and the amount of the platinum-group metal contained in the precipitate was calculated.

FIG. 1 indicates a relationship between the hydrochloric acid concentration (HCl [M] (mol/L)) and the metal recovery rate (Precipitation [%]). As is apparent from FIG. 1, it can be understood that, by using m-xylylenediamine as the platinum-group metal recovery agent, platinum can be selectively recovered as a precipitate in a wide range of hydrochloric acid concentrations of 1 mol/L or more.

Example 2: Influence of Shaking Time

Figure 2:
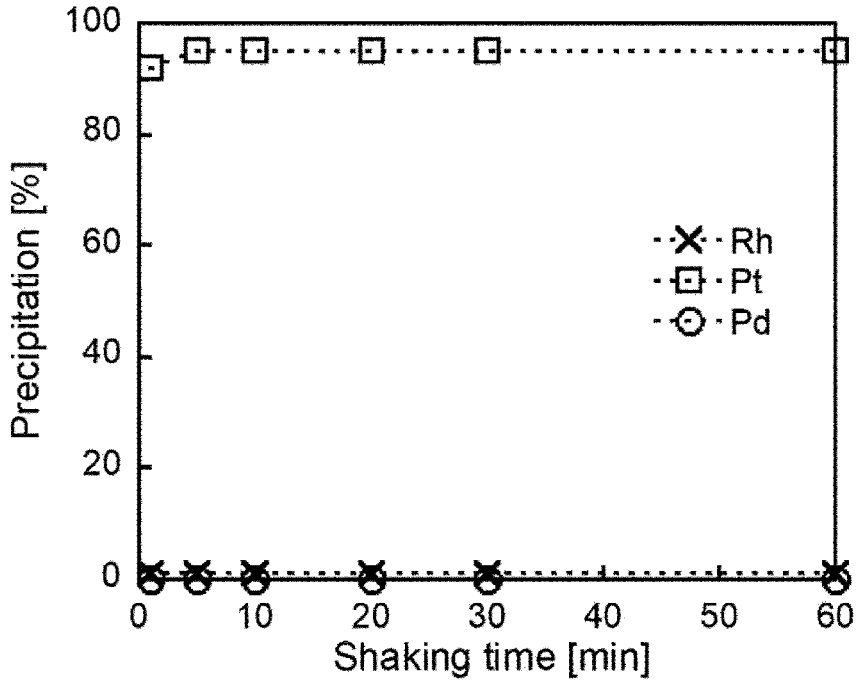
FIG. 2 is a graph indicating the influence of shaking time on the recovery of platinum in Example 2.

A precipitate and a solution were obtained in the same manner as in Example 1 except that the hydrochloric acid concentration of the hydrochloric acid solution was 8 mol/L and that the shaking time was changed as indicated in FIG. 2, and the amount of the platinum-group metal contained in the precipitate was calculated.

FIG. 2 indicates a relationship between the shaking time (Shaking time [min]) and the metal recovery rate (Precipitation [%]). As is apparent from FIG. 2, 92% of platinum could be recovered by shaking for 1 minute, and 95% or more of platinum could be recovered as a precipitate by shaking for 10 minutes or longer. Neither palladium nor rhodium were recovered as precipitates.

Example 3: Influence of Molar Ratio Between Platinum-Group Metal Recovery Agent and Platinum A precipitate and a solution were obtained in the same manner as in Example 1 except that the hydrochloric acid concentration of the hydrochloric acid solution was 8 mol/L, that the shaking time was 10 minutes, and that the amount of the platinum-group metal recovery agent (m-xylylenediamine) added was changed as indicated in FIG. 3, and the amount of the platinum-group metal contained in the precipitate was calculated.

Figure 3:
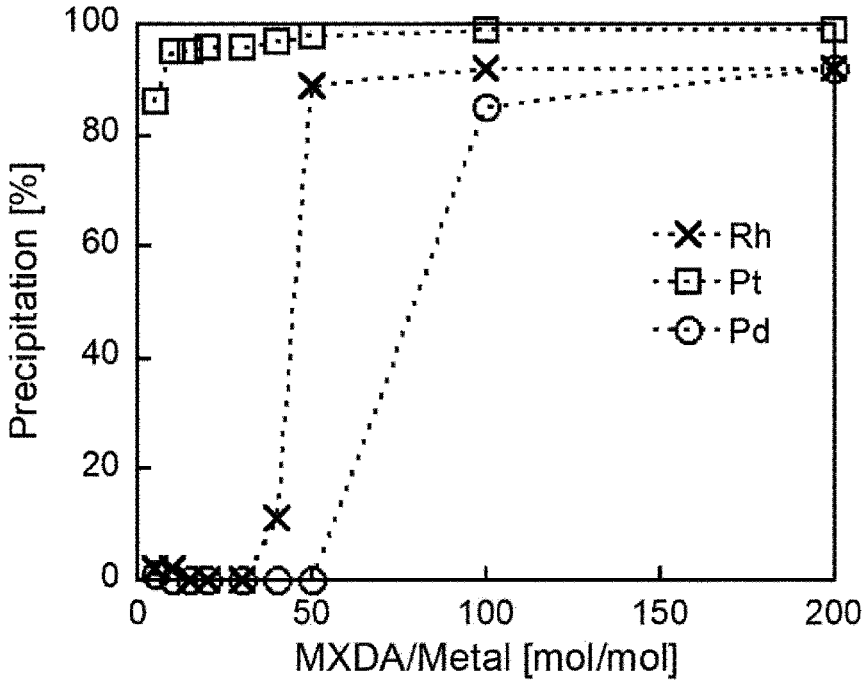
FIG. 3 is a graph indicating the influence of molar ratio between a platinum-group metal recovery agent and platinum in the recovery of platinum in Example 3.

FIG. 3 indicates a relationship between the amount of m-xylylenediamine added (MXDA/Metal [mol/mol] (the amount of m-xylylenediamine added relative to the amount of the platinum-group metal)) and the metal recovery rate (Precipitation [%]). As is apparent from FIG. 3, it can be understood that, under the condition that the amount of m-xylylenediamine added is 5 times (mol/mol) or more the amount of platinum, 86% or more of platinum can be recovered as a precipitate, and that the platinum recovery rate is high. It can also be understood that platinum can be selectively recovered as a precipitate under the condition that the amount of m-xylylenediamine added is 40 times (mol/mol) or less the amount of platinum.

Recovery of Rhodium

Figure 4:
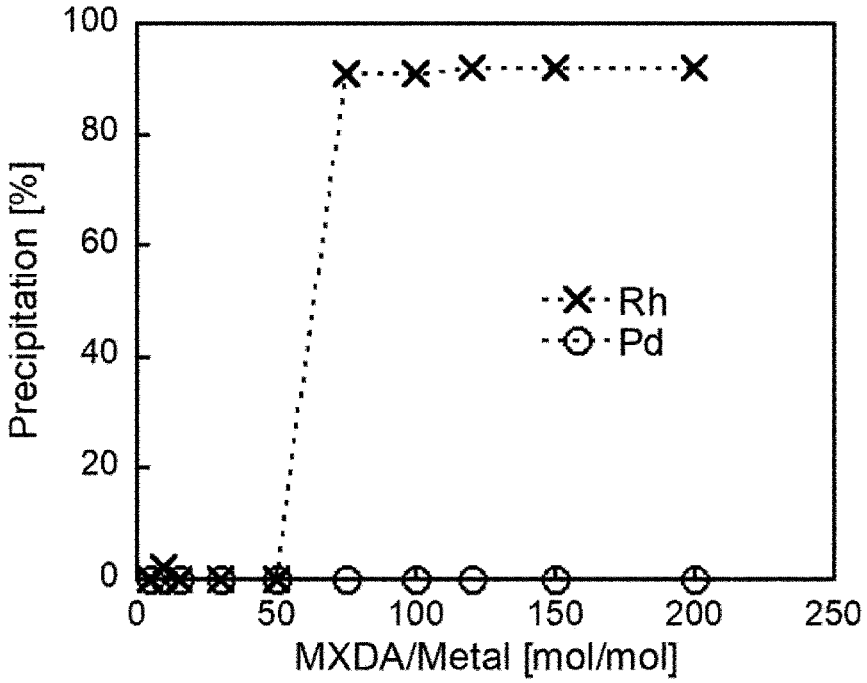
FIG. 4 is a graph indicating the influence of molar ratio between the platinum-group metal recovery agent and rhodium on the recovery of rhodium in Example 4.

Example 4: Influence of Molar Ratio Between Platinum-Group Metal Recovery Agent and Rhodium m-Xylylenediamine was added as the platinum-group metal recovery agent, in an amount as indicated in FIG. 4, to a hydrochloric acid solution containing 500 mg/L of palladium and 500 mg/L of rhodium (hydrochloric acid concentration: 8 mol/L). The m-xylylenediamine used here was a hydrochloride. Thereafter, the mixture was shaken at 25° C. for 1 hour to obtain a precipitate. The obtained precipitate and the solution were subjected to solid-liquid separation by centrifugal separation. The solution obtained after the solid-liquid separation was analyzed by ICP, and the amount of the platinum-group metal contained in the precipitate was calculated.

FIG. 4 indicates a relationship between the amount of m-xylylenediamine added (MXDA/Metal [mol/mol] (the amount of m-xylylenediamine added relative to the amount of the platinum-group metal)) and the metal recovery rate (Precipitation [%]). As is apparent from FIG. 4, under the condition that the amount of m-xylylenediamine added was 75 times (mol/mol) or more the amount of rhodium, 90% or more of rhodium could be recovered as a precipitate, and the rhodium recovery rate was high. Also, it can be understood that palladium is not recovered regardless of the amount of m-xylylenediamine added, and that rhodium can be selectively recovered as a precipitate.

Example 5: Influence of Shaking Time

Figure 5:
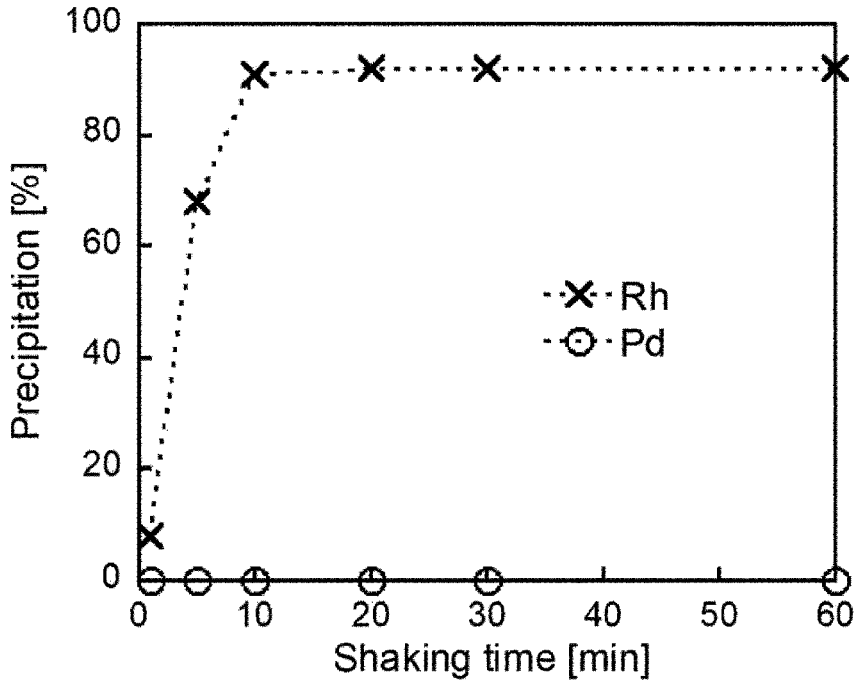
FIG. 5 is a graph indicating the influence of shaking time on the recovery of rhodium in Example 5.

A precipitate and a solution were obtained in the same manner as in Example 4 except that the shaking time was changed as indicated in FIG. 5, and the amount of the platinum-group metal contained in the precipitate was calculated.

FIG. 5 indicates a relationship between the shaking time (Shaking time [min]) and the metal recovery rate (Precipitation [%]) when m-xylylenediamine was added in an amount which was 100 times (mol/mol) the amount of rhodium. As is apparent from FIG. 5, 90% or more of rhodium could be recovered as a precipitate by shaking for 10 minutes or longer, and palladium was not recovered.

Crystal (Precipitate) Containing Platinum-Group Metal Atom and Platinum-Group Metal Recovery Agent

Example 6: Crystal (Precipitate) Containing Platinum Atom and Platinum-Group Metal Recovery Agent m-Xylylenediamine was added as the platinum-group metal recovery agent, in an amount which was twice (mol/mol) the amount of platinum, to a hydrochloric acid solution (hydrochloric acid concentration: 8 mol/L) containing 1000 mg/L of platinum. The m-xylylenediamine used here is a hydrochloride. Thereafter, the mixture was shaken at 25° C. to obtain a precipitate. The hydrochloric acid solution containing the precipitate was allowed to stand for several days to obtain crystals. The obtained crystals (about 2 mm) and the solution were subjected to solid-liquid separation by filtration. When the crystals were subjected to thermogravimetric analysis, single crystal X-ray structure analysis, and powder X-ray diffraction analysis, it was found that the crystals were crystals having the molar ratio of platinum atoms to the platinum-group metal recovery agent in the crystals, [platinum atom:platinum-group metal recovery agent], of 1:1.

Example 7: Crystal (Precipitate) Containing Rhodium Atom and Platinum-Group Metal Recovery Agent m-Xylylenediamine was added as the platinum-group metal recovery agent, in an amount which was 50 times (mol/mol) the amount of rhodium, to a hydrochloric acid solution (hydrochloric acid concentration: 8 mol/L) containing 500 mg/L of rhodium. The m-xylylenediamine used here is a hydrochloride. Thereafter, the mixture was shaken at 25° C. to obtain a precipitate. The hydrochloric acid solution containing the precipitate was allowed to stand for several days to obtain crystals. The obtained crystals (about 2 mm) and the solution were subjected to solid-liquid separation by filtration. When the crystals were subjected to thermogravimetric analysis, single crystal X-ray structure analysis, and powder X-ray diffraction analysis, it was found that the crystals were crystals having the molar ratio of rhodium atoms to the platinum-group metal recovery agent in the crystals, [rhodium atom:platinum-group metal recovery agent], of 1:2.

Sequential Recovery of Platinum and Rhodium

Example 8

(Platinum Recovery Step: First Step)

m-Xylylenediamine was added as the platinum-group metal recovery agent, in an amount which was 15 times (mol/mol) the amount of platinum, to a hydrochloric acid solution (hydrochloric acid concentration: 8 mol/L) containing 500 mg/L of palladium, 1000 mg/L of platinum and 500 mg/L of rhodium. The m-xylylenediamine used here is a hydrochloride. Thereafter, the mixture was shaken at 25° C. for 10 minutes to obtain a precipitate. The obtained precipitate and the solution were subjected to solid-liquid separation by filtration.

The solution obtained after the solid-liquid separation was analyzed by ICP, and the amount of the platinum-group metal contained in the precipitate was calculated. The precipitate contained platinum in an amount which was 96% of the amount of platinum contained in the initial hydrochloric acid solution, rhodium in an amount which was 3% of the amount of rhodium contained in the initial hydrochloric acid solution, and no palladium.

When the precipitate was subjected to thermogravimetric analysis and powder X-ray diffraction analysis, it was found that the precipitate contained crystals having the molar ratio of platinum atoms to the platinum-group metal recovery agent in the crystals, [platinum atom:platinum-group metal recovery agent], of 1:1.

(Rhodium Recovery Step: Second Step)

Next, m-xylylenediamine was added as the platinum-group metal recovery agent, in an amount which was 90 times (mol/mol) the amount of rhodium, to the solution obtained after the solid-liquid separation in the previous step. The mixture was shaken at 25° C. for 10 minutes, and the obtained precipitate and the solution were subjected to solid-liquid separation by filtration. The m-xylylenediamine used here is a hydrochloride.

The solution obtained after the solid-liquid separation was analyzed by ICP, and the amount of the platinum-group metal contained in the precipitate was calculated. The precipitate contained rhodium in an amount which was 86% of the amount of rhodium contained in the initial hydrochloric acid solution, platinum in an amount which was 3% of the amount of platinum contained in the initial hydrochloric acid solution, and palladium in an amount which was 5% of the amount of palladium contained in the initial hydrochloric acid solution.

When the precipitate was subjected to thermogravimetric analysis and powder X-ray diffraction analysis, it was found that the precipitate contained crystals having the molar ratio of rhodium atoms to the platinum-group metal recovery agent in the crystals, [rhodium atom:platinum-group metal recovery agent], of 1:2.

The solution obtained after the solid-liquid separation contained platinum in an amount which was 1% of the amount of platinum contained in the initial hydrochloric acid solution, rhodium in an amount which was 11% of the amount of rhodium contained in the initial hydrochloric acid solution, and palladium in an amount which was 95% of the amount of palladium contained in the initial hydrochloric acid solution.

As can be understood from the results of Example 8, the use of the platinum-group metal recovery agent of the present invention can selectively recover platinum at a high recovery rate from the hydrochloric acid solution containing palladium, platinum and rhodium, and can selectively recover rhodium at a high recovery rate from the hydrochloric acid solution containing palladium and rhodium.

Example 9: Example in Which Crystal Nucleating Agent was Used in Rhodium Recovery Step (Platinum Recovery Step: First Step)

m-Xylylenediamine was added as the platinum-group metal recovery agent, in an amount which was 15 times (mol/mol) an amount of platinum, to a hydrochloric acid solution (hydrochloric acid concentration: 8 mol/L) containing 500 mg/L of palladium, 1000 mg/L of platinum and 500 mg/L of rhodium. The m-xylylenediamine used here is a hydrochloride. Thereafter, the mixture was shaken at 25° C. for 10 minutes to obtain a precipitate. The obtained precipitate and the solution were subjected to solid-liquid separation by filtration.

The solution obtained after the solid-liquid separation was analyzed by ICP, and the amount of the platinum-group metal contained in the precipitate was calculated. The precipitate contained platinum in an amount which was 96% of the amount of platinum contained in the initial hydrochloric acid solution, rhodium in an amount which was 3% of the amount of rhodium contained in the initial hydrochloric acid solution, and palladium in an amount which was 0.7% of the amount of palladium contained in the initial hydrochloric acid solution.

(Rhodium Recovery Step (Example Using Crystal Nucleating Agent): Second Step)

Next, m-xylylenediamine was added as the platinum-group metal recovery agent, in an amount which was 20 times (mol/mol) the amount of rhodium, to the solution obtained after the solid-liquid separation in the previous step, and 5 grains of the crystals (size: about 2 mm) containing rhodium atoms and the platinum-group metal recovery agent, which were obtained in Example 7, were further added as the crystal nucleating agent. The mixture was shaken at 25° C. for 10 minutes, and the obtained precipitate and the solution were subjected to solid-liquid separation by filtration. The m-xylylenediamine used here is a hydrochloride.

The solution obtained after the solid-liquid separation was analyzed by ICP, and the amount of the platinum-group metal contained in the precipitate was calculated. The precipitate contained rhodium in an amount which was 93% of the amount of rhodium contained in the initial hydrochloric acid solution, platinum in an amount which was 2% of the amount of platinum contained in the initial hydrochloric acid solution, and palladium in an amount which was 0.6% of the amount of palladium contained in the initial hydrochloric acid solution.

The solution obtained after the solid-liquid separation contained platinum in an amount which was 2% of the amount of platinum contained in the initial hydrochloric acid solution, rhodium in an amount which was 4% of the amount of rhodium contained in the initial hydrochloric acid solution, and palladium in an amount which was 99% of the amount of palladium contained in the initial hydrochloric acid solution.

As can be understood from the results of Example 9, the use of the crystal nucleating agent in the rhodium recovery step can more selectively recover rhodium even when a small amount of the platinum-group metal recovery agent is used.

Recovery From Catalyst Leaching Simulated Solution

Example 10

Assuming that platinum-group metals were recovered from used automobile exhaust gas purifying catalysts, the platinum recovery step (first step) and the rhodium recovery step (second step) were performed by the same operations as in Example 9 using simulated leaching solutions (hydrochloric acid concentration: 8 mol/L) containing various metals as indicated in Table 1. The solutions obtained after the solid-liquid separation in each of the steps were analyzed by ICP, the amount of each of the metals contained in the precipitates was determined, and the metal recovery rates were calculated. The m-xylylenediamine used in the first step and the second step is a hydrochloride. The results are indicated in Table 1.

TABLE 1

| Metal species | Initial metal concentration (ppm) | Metal recovery rate in first step (%) | Metal recovery rate in second step (%) |
|---|---|---|---|
| Pd | 475 | 0.9 | 2.2 |
| Pt | 990 | 94.0 | 0.6 |
| Rh | 486 | 0.8 | 88.0 |
| Ce | 6451 | 0.0 | 0.0 |
| Al | 3639 | 0.0 | 0.0 |
| Zr | 515 | 0.0 | 0.0 |
| La | 68 | 0.0 | 0.3 |
| Ba | 330 | 0.1 | 0.0 |

As indicated in Table 1, even when hydrochloric acid solutions containing various metals other than platinum-group metals were used, platinum could be selectively recovered as a precipitate in the first step, and rhodium could be selectively recovered as a precipitate in the second step.

Example 11: Recovery of Platinum (Example Using P-xylylenediamine as Platinum-Group Metal Recovery Agent)

P-xylylenediamine was added as the platinum-group metal recovery agent, in an amount which was 15 times (mol/mol) the amount of platinum, to an 8 mol/L hydrochloric acid solution containing 500 mg/L of palladium, 1000 mg/L of platinum, and 500 mg/L of rhodium. The p-xylylenediamine used here is a hydrochloride. Thereafter, the mixture was shaken at 25° C. for 1 hour to obtain a precipitate. The obtained precipitate and the solution were subjected to solid-liquid separation by centrifugal separation. The solution obtained after the solid-liquid separation was analyzed by ICP, and the amount of the platinum-group metal contained in the precipitate was calculated.

As a result, 74% of platinum was recovered as a precipitate. In addition, only 4% of palladium and only 1% of rhodium were recovered as precipitates, and it can be understood that platinum can be selectively recovered as a precipitate.

The invention claimed is:

1. A platinum-group metal recovery method, which is a method of recovering platinum from a hydrochloric acid solution containing platinum using a platinum-group metal recovery agent represented by the following general Formula (1):

(1)

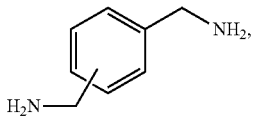

the platinum-group metal recovery method comprising mixing the platinum-group metal recovery agent and the hydrochloric acid solution to precipitate platinum.

2. The platinum-group metal recovery method according to claim 1, wherein the hydrochloric acid solution comprises at least one selected from the group consisting of palladium and rhodium.

3. The platinum-group metal recovery method according to claim 1, wherein a molar ratio of the platinum-group metal recovery agent to the platinum contained in the hydrochloric acid solution, ranges from 5 to less than 40.

4. A platinum-group metal recovery method, which is a method of recovering rhodium from a hydrochloric acid solution containing rhodium using a platinum-group metal recovery agent represented by the following general Formula (1):

(1)

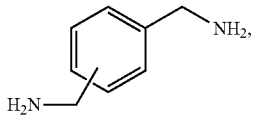

the platinum-group metal recovery method comprising mixing the platinum-group metal recovery agent and the hydrochloric acid solution to precipitate rhodium.

5. The platinum-group metal recovery method according to claim 4, wherein the hydrochloric acid solution comprises palladium.

6. The platinum-group metal recovery method according to claim 4, wherein a molar ratio of the platinum-group metal recovery agent to the rhodium contained in the hydrochloric acid solution, is 15 or more.

7. A platinum-group metal recovery method, which is a method of separating and recovering platinum and rhodium from a hydrochloric acid solution containing platinum and rhodium using a platinum-group metal recovery agent represented by the following general Formula (1):

(1)

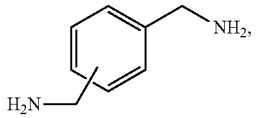

the platinum-group metal recovery method comprising: recovering platinum by mixing the platinum-group metal recovery agent and the hydrochloric acid solution to obtain a precipitate containing platinum and a solution containing rhodium and recovering platinum; and recovering rhodium by mixing the platinum-group metal recovery agent and the solution containing rhodium to obtain a precipitate containing rhodium and recovering rhodium.

8. The platinum-group metal recovery method according to claim 7, wherein the hydrochloric acid solution contains palladium, the platinum recovery includes obtaining a precipitate containing platinum and the solution containing rhodium contains rhodium and palladium, and the rhodium recovery includes obtaining a precipitate containing rhodium and a solution containing palladium.

9. The platinum-group metal recovery method according to claim 7, wherein, during the rhodium recovery, a crystal nucleating agent is further mixed in addition to the platinum-group metal recovery agent and the solution containing rhodium.

10. The platinum-group metal recovery method according to claim 1, wherein a molar ratio of the platinum-group metal recovery agent to the platinum contained in the hydrochloric acid solution, ranges from 2 to less than 40.

11. The platinum-group metal recovery method according to claim 4, wherein a molar ratio of the platinum-group metal recovery agent to the rhodium contained in the hydrochloric acid solution, is 40 or more.

12. The platinum-group metal recovery method according to claim 4, wherein a molar ratio of the platinum-group metal recovery agent to the rhodium contained in the hydrochloric acid solution, ranges from 40 to less than 200.

13. The platinum-group metal recovery method according to claim 7, wherein a molar ratio of the platinum-group metal recovery agent to the platinum contained in the hydrochloric acid solution, ranges from 5 to less than 40.

14. The platinum-group metal recovery method according to claim 7, wherein a molar ratio of the platinum-group metal recovery agent to the platinum contained in the hydrochloric acid solution, ranges from 2 to less than 40.

15. The platinum-group metal recovery method according to claim 7, wherein a molar ratio of the platinum-group metal recovery agent to the rhodium contained in the hydrochloric acid solution, is 15 or more.

16. The platinum-group metal recovery method according to claim 7, wherein a molar ratio of the platinum-group metal recovery agent to the rhodium contained in the hydrochloric acid solution, is 40 or more.

17. The platinum-group metal recovery method according to claim 7, wherein a molar ratio of the platinum-group metal recovery agent to the rhodium contained in the hydrochloric acid solution, ranges from 40 to less than 200.

18. The platinum-group metal recovery method according to claim 7, wherein:

a molar ratio of the platinum-group metal recovery agent to the platinum contained in the hydrochloric acid solution, ranges from 2 to less than 40, and a molar ratio of the platinum-group metal recovery agent to the rhodium contained in the hydrochloric acid solution, is 15 or more.

19. The platinum-group metal recovery method according to claim 7, wherein:

a molar ratio of the platinum-group metal recovery agent to the platinum contained in the hydrochloric acid solution, ranges from 5 to less than 40, and a molar ratio of the platinum-group metal recovery agent to the rhodium contained in the hydrochloric acid solution, is 40 or more.

20. The platinum-group metal recovery method according to claim 7, wherein:

a molar ratio of the platinum-group metal recovery agent to the platinum contained in the hydrochloric acid solution, ranges from 2 to less than 40, and a molar ratio of the platinum-group metal recovery agent to the rhodium contained in the hydrochloric acid solution, ranges from 40 to less than 200.

* * * * *